US012187473B2

(12) United States Patent
Soh et al.

(10) Patent No.: US 12,187,473 B2
(45) Date of Patent: Jan. 7, 2025

(54) DRYING AGENT BAG SHAPING AND PUSHING DEVICE AND FULLY AUTOMATIC WAFER PACKAGING SYSTEM

(71) Applicant: Zhejiang Darcet Technology Co, Ltd, Zhejiang (CN)

(72) Inventors: Boon Wah Soh, Zhejiang (CN); Yankun Cai, Zhejiang (CN)

(73) Assignee: Zhejiang Darcet Technology Co, Ltd, Zhejiang (CN)

( * ) Notice: Subject to any disclaimer, the term of this patent is extended or adjusted under 35 U.S.C. 154(b) by 0 days.

(21) Appl. No.: 18/738,164

(22) Filed: Jun. 10, 2024

(65) Prior Publication Data

US 2024/0351724 A1 Oct. 24, 2024

Related U.S. Application Data

(63) Continuation of application No. PCT/CN2023/118934, filed on Sep. 15, 2023.

(30) Foreign Application Priority Data

Apr. 21, 2023 (CN) ..... 202310433552.0
Apr. 21, 2023 (CN) ..... 202310433613.3

(51) Int. Cl.
*B65B 31/02* (2006.01)
*B65B 61/20* (2006.01)
(Continued)

(52) U.S. Cl.
CPC ..... *B65B 31/02* (2013.01); *B65B 61/20* (2013.01); *B65B 61/24* (2013.01); *B65D 81/268* (2013.01); *B65B 2220/14* (2013.01)

(58) Field of Classification Search
CPC ..... B65B 31/02; B65B 61/20; B65B 61/24; B65B 2220/14; B65D 81/268
(Continued)

(56) References Cited

U.S. PATENT DOCUMENTS 689,474 A * 12/1901 Fales ..... B65B 1/22 53/526
1,974,165 A * 9/1934 Stage ..... B65B 25/046 53/526
(Continued)

FOREIGN PATENT DOCUMENTS

CN 111252327 A 6/2020
CN 111619899 A 9/2020
(Continued)

*Primary Examiner* — Stephen F. Gerrity
(74) *Attorney, Agent, or Firm* — Calfee, Halter & Griswold LLP

(57) ABSTRACT

A drying agent bag shaping and pushing device are provided, wherein a transverse moving block is slidably connected to a transverse moving rail, a short connecting block is connected to a long connecting block, a shaping platform is connected to a short connecting block, a lifting frame is provided on the shaping platform, lifting cylinders are connected to two sides of the lifting frame, a clamping cylinder is fixedly connected to a bottom surface of the lifting frame, a clamping plate connecting plate is connected to a cylinder connecting plate, a clamping plate is connected to the clamping plate connecting plate, a positioning plate is provided between the clamping plates, a front end and a rear end of the positioning plate are connected to two sides of the lifting frame, and a material pushing mechanism is provided on a side of the shaping platform away from the traverse moving rail.

12 Claims, 8 Drawing Sheets

(51) Int. Cl.
*B65B 61/24* (2006.01)
*B65D 81/26* (2006.01)

(58) Field of Classification Search
USPC ..... 53/400, 512, 526
See application file for complete search history.

(56) References Cited

U.S. PATENT DOCUMENTS

| | | | | |
|---|---|---|---|---|
| 2,714,792 | A * | 8/1955 | Wright et al. | B65B 7/20 53/526 |
| 6,102,198 | A | 8/2000 | Merrell | |
| 2006/0288665 | A1* | 12/2006 | Imao | B65B 31/046 53/512 |
| 2019/0315506 | A1* | 10/2019 | Sun | B65B 61/20 |

FOREIGN PATENT DOCUMENTS

| | | | |
|---|---|---|---|
| CN | 112429306 | A | 3/2021 |
| CN | 217261138 | U | 8/2022 |
| CN | 115303586 | A | 11/2022 |
| CN | 116495297 | A | 7/2023 |
| CN | 116639347 | A | 8/2023 |
| JP | 2005153923 | A | 6/2005 |

* cited by examiner

--Prior Art--

--Prior Art--

DRYING AGENT BAG SHAPING AND PUSHING DEVICE AND FULLY AUTOMATIC WAFER PACKAGING SYSTEM

CROSS-REFERENCE TO RELATED APPLICATIONS

The present application is a bypass continuation of International Application No. PCT/CN2023/118934 filed on Sep. 15, 2023, which claims priority to Chinese Patent Application No. 202310433552.0 filed on Apr. 21, 2023 and the Chinese Patent Application No. 202310433613.3 filed on Apr. 21, 2023, the contents of which are incorporated herein by reference.

FIELD

The present disclosure relates to the technical field of production packaging equipment, in particular to a drying agent bag shaping and pushing device and a fully automatic wafer packaging system.

BACKGROUND

At present, wafer packaging is carried out with automatic equipment. The wafer packaging process is as follows: a processed wafer is placed into a wafer box; the wafer box is capped; a label is attached to the surface of the wafer box; the wafer box is placed into an aluminum foil bag after it is labeled; a drying agent bag is pushed into the aluminum foil bag; then the aluminum foil bag is vacuumized; the opening of the aluminum foil bag is sealed after the aluminum foil bag is vacuumized; a label is attached to the surface of the aluminum foil bag; finally, the vacuumized aluminum foil bag is packed in a paper packing box. After the wafer box is placed into the aluminum foil bag, the space in the bag is small, and the drying agent bag has to be shaped before it is pushed into the aluminum foil bag, so that the drying agent bag can be pushed into the aluminum foil bag easily.

The drying agent bag shaping device used in the existing wafer packaging system functions as follows: a groove is arranged in the middle of the bottom of a bearing tray (as shown in FIG. 1), a top clamping device (as shown in FIG. 2) is moved downward under the pushing action of an air cylinder, a top plate in the middle of the clamping device pushes the middle part of the drying agent bag downward into the groove in the middle of the bottom of the bearing tray, similar to press-forming. Then, side edges of the drying agent bag are turned up toward the middle part, and calipers on the two sides of the clamping device extend downward to the sides of the up-turned part of the drying agent bag respectively. The calipers are driven by another air cylinder to repeatedly clamp and loosen the up-turned part of the drying agent bag in the middle for several times, so that the shaped drying agent bag will not get loose easily. After the shaping, the calipers clamp the drying agent bag and lift it upward under the pushing action of the air cylinder, the bearing tray is removed, a material feeding base is pushed by a material pushing cylinder at a side of the clamping device to the bottom of the drying agent bag, the clamping device is moved downward, the calipers are released and then return to the top. Then, the drying agent bag is placed on the material feeding base, the material feeding base is pushed by the air cylinder to get close to a sealing part of the aluminum foil bag, and the drying agent bag is pushed by a material pushing plate located at a side of the material feeding base into the aluminum foil bag. In that process, the calipers on the two sides of the clamping device only clamp the two sides of the up-turned part of the drying agent bag, while the middle portion of the up-turned part of the drying agent bag is not clamped. In the process of pushing the drying agent bag into the aluminum foil bag by the material pushing plate, the drying agent bag is squeezed on one side, so that the middle portion of the up-turned part of the drying agent bag bulges outward, causing the drying agent bag to fall apart. After the drying agent bag falls apart, a part of the drying agent bag protrudes into the vacuum sealing part. Consequently, the sealing part can't be sealed completely, and air enters the aluminum foil bag, bringing an adverse effect to the storage of the wafer inside the aluminum foil bag. Moreover, the drying agent particles at a bend between the middle part of the drying agent bag and the up-turned part (as shown in FIG. 3) are squeezed together, and have certain outward resilience. After the external force on the up-turned part of the drying agent bag is removed, in the process of pushing the drying agent bag into the aluminum foil bag by the material pushing plate, the drying agent bag is subjected to extrusion pressure on one side, and the resilience force at the bend causes the up-turned part of the drying agent bag to turn outward, so that the drying agent bag falls apart. After the drying agent bag falls apart, a part of the drying agent bag protrudes to the vacuum sealing part; as a result, the sealing part can't be sealed completely, and air enters the aluminum foil bag, bringing an adverse effect to the storage of the wafer inside the aluminum foil bag.

SUMMARY

(I) Technical Problem to be Solved

In view of the drawbacks in the prior art, in one aspect, the present disclosure provides a drying agent bag shaping and pushing device, which solves the problems existing in the prior art, and solves the problems that the shaped drying agent bag falls apart before it enters an aluminum foil bag and the drying agent bag rebounds into the sealing part of the aluminum foil bag.

In view of the drawbacks in the prior art, in another aspect, the present disclosure provides a fully automatic wafer packaging system, which solves the problems existing in the prior art, and solves the problems that the shaped drying agent bag falls apart before it enters the aluminum foil bag and the drying agent bag rebounds into the sealing part of the aluminum foil bag.

(II) Technical Solution

To attain the objects described above, the present disclosure provides the following technical scheme:

A drying agent bag shaping and pushing device, comprising a device base, wherein a traverse moving rail is fixedly connected to a side of a top surface of the device base, a traverse moving block is slidably connected to a top surface of the traverse moving rail, a long connecting block is fixedly connected to a top surface of the traverse moving block, a short connecting block is fixedly connected to an end of the long connecting block away from the traverse moving block, a shaping platform is fixedly connected to a top surface of the short connecting block, a lifting frame is provided on top of the shaping platform, lifting cylinders are fixedly connected to two sides of the lifting frame, a clamping cylinder is fixedly connected to a bottom surface of the clamping cylinder, cylinder connecting plates are fixedly connected to two sides of a bottom surface of the clamping cylinder, a clamping plate connecting plate is fixedly connected to a bottom surface of the cylinder connecting plate, and a clamping plate is fixedly connected to a bottom surface of the clamping plate connecting plate.

Preferably, a positioning plate is provided between the clamping plates, a front end and a rear end of the positioning plate are fixedly connected to two sides of the lifting frame via positioning plate connecting blocks, and a material pushing mechanism is provided on a side of the shaping platform away from the transverse moving rail.

Preferably, a middle plate is fixedly connected to a middle part of the shaping platform, side flaps are symmetrically provided on two sides of the middle plate, a lifting pull plate is provided at the bottom of the middle plate, a pull plate lifting cylinder is fixedly connected to a bottom surface of the lifting pull plate, the side flaps and the lifting pull plate are hinged together via an overturning shaft, a toothed rack is provided on a bottom surface of the side flap, an end of the toothed rack near the overturning shaft is meshed with a bearing gear, a gear shaft is fixedly connected to a middle part of the bearing gear; two ends of the gear shaft are fixedly connected to two side walls of the shaping platform, and an elastic member is connected to an end of the side flap away from the overturning shaft, a fixing base is fixedly connected to the other end of the elastic member, and the fixing base is fixedly connected to a side wall of the shaping platform.

Preferably, a supporting block is provided at the bottom of an end of the side flap fixedly connected with the elastic member, and a top surface of the supporting block is at the same level as the bottom surface of the side flap.

Preferably, the middle part of the lifting pull plate is a lifting pull plate body, overturning arms are provided at four corners of the lifting pull plate body, and gaps exist between the overturning arms located at two ends of the lifting pull plate body respectively.

Preferably, an ejecting block is provided between the middle plate and the side flap, and a bottom of the ejecting block passing through the lifting pull plate is fixedly connected with an ejecting cylinder.

Preferably, the positioning plate is in the shape of a kitchen knife, has a rear adjustment hole at the handle and a front adjustment hole at the blade, and is fixedly connected with a squeezed filler part at the bottom, and the squeezed filler part is made of an elastic and easily deformable material.

Preferably, the clamping plate is provided with a clamping plate bevel surface at the bottom of a side of the clamping plate near the positioning plate.

Preferably, the clamping plate is provided with a plurality of vertical long grooves on a side of the clamping plate near the positioning plate.

Preferably, the vertical long grooves are formed in a way that their distribution changes from sparse to dense in a direction away from the traverse moving rail.

Preferably, the material pushing mechanism comprises a material feeding base, a flat placing plate is fixedly connected to a top surface of the material feeding base, an suction disc is provided on a middle part of the flat placing plate, a side material pushing guide plate is provided on a side of the suction disc, a material pushing block is provided over the material feeding base, a material pushing rod is fixedly connected to a side of the material pushing block near the top, a material pushing cylinder is fixedly connected to the other end of the material pushing rod, a ranging guide base is fixedly connected to its top of the material pushing cylinder, a moving guide rod is slidably connected to a middle part of the ranging guide base, an end of the moving guide rod is fixedly connected with the material pushing block, a long material pushing connecting block is fixedly connected to a bottom surface of the ranging guide base, a material pushing moving block is fixedly connected to the bottom surface of an end of the long material pushing connecting block away from the material pushing block, and a material pushing moving guide rail is slidably connected to a bottom surface of the material pushing moving block.

A fully automatic wafer packaging system, comprising a wafer boxing device, wherein a wafer box capping device is fixedly connected to an end of the wafer boxing device, a wafer box labeling device is fixedly connected to the other side of the wafer box capping device, an aluminum foil bag feeding device is fixedly connected to the other side of the wafer box labeling device, an aluminum foil bag opening and shaping device is fixedly connected to the other side of the aluminum foil bag feeding device, the drying agent bag shaping and pushing device of any of the above technical schemes is fixedly connected to the other side of the aluminum foil bag opening and shaping device, a vacuum sealing device is fixedly connected to one side of the drying agent bag shaping and pushing device, and a packaging device is fixedly connected to the other side of the drying agent bag shaping and pushing device.

(III) Benefits

Compared with the prior art, the drying agent bag shaping and pushing device of the present disclosure has the following four beneficial effects:

1. In the drying agent bag shaping and pushing device of the present disclosure, the ejecting cylinder ejects upward to drive the ejecting block to eject upward, so that the left and right sides of the fixed part of the drying agent bag are ejected up, the drying agent in the drying agent bag is separated to the two sides of the ejecting block; then the ejecting cylinder retracts downward and drives the ejecting block to retract downward, and, at that point, strip-shaped gaps without drying agent are formed at the left and right sides of the fixed part of the drying agent bag; then the pulling plate lifting cylinder pulls the lifting pulling plate to move downward, the side flaps are driven to turn over around the overturning shaft; thus, the drying agent will not enter the overturned part formed when the two sides of the drying agent bag are turned over, the overturned part will not produce resilience force, and the overturned part of the drying agent bag will not fall outward easily.
2. In the drying agent bag shaping and pushing device of the present disclosure, a clamping plate bevel surface is arranged at the bottom of a side of the clamping plate near the positioning plate, the clamping cylinder retracts to drive the clamping plates at the two sides to clamp toward the middle positioning plate, the clamping plate bevel surfaces at the bottom of the clamping plates can force the drying agent bag to form an inclined part when it is squeezed by the clamping plates, and an squeezed bent part is formed between the inclined part and the squeezed vertical part, and the angle of the squeezed bent part is an obtuse angle, the drying agent in the squeezed bent part is squeezed and compressed, and a resilience force is formed inside the drying agent. Thus, when the support of the positioning plate is lost, the squeezed vertical part falls toward the middle part under the action of the resilience force, forming a triangle-like shape; thereby the drying agent bag will not fall apart easily, and the stability of the drying agent bag is improved.

3. In the drying agent bag shaping and pushing device of the present disclosure, a plurality of vertical long grooves are arranged on a side of the clamping plate near the positioning plate, and the vertical long grooves are arranged in a way that their distribution changes from sparse to dense in a direction away from the traverse moving rail. Thus, when a side of the clamping plate squeezes the squeezed vertical part of the drying agent bag, a portion of the squeezed vertical part of the drying agent bag enters the vertical long grooves, forming convex side ribs in a vertical strip shape, which can play a role of strengthening the structure of the squeezed vertical part of the drying agent bag; the convex side ribs are also arranged in a way that their distribution changes from sparse to dense in the direction away from the traverse moving rail; when the material pushing mechanism pushes the shaped drying agent bag toward the packaging bag, the side with sparsely arranged convex side ribs enters the packaging bag first; when the drying agent bag is pushed to the inner wafer box, the end of the drying agent bag that enters the packaging bag first falls apart because the strength of the portion of the drying agent bag with densely arranged convex side ribs is greater than that of the portion of the drying agent bag with sparsely arrange convex side ribs; the portion of the drying agent bag that has fallen apart fills the space inside the packaging bag, consequently the outward resilience force produced by the accumulation and squeezing of the drying agent bag is decreased, so that the portion of the drying agent bag that enters the packaging bag later can fall apart. The device of the present disclosure prevents the drying agent bag from falling part before entering the packaging bag, so that the drying agent bag can fully utilize the internal space of the packaging bag, and will not be pushed out to the sealing part of the packaging bag easily by the resilience force generated by internal squeezing; the device can prevent the air from entering the aluminum foil bag and affecting the storage of the wafer therein.

4. In the drying agent bag shaping and pushing device of the present disclosure, a squeezed filler part is fixedly connected at the bottom of the positioning plate, and the squeezed filler part is made of an elastic and easily deformable material. Thus, the squeezed filler part can be squeezed and deformed as the positioning plate squeezes downward, so that it fills the shaping space formed at the middle part of the shaped drying agent bag. When the positioning plate is withdrawn upward, the inclined part, the squeezed bent part and the squeezed vertical part of the shaped drying agent bag are overturned to the middle part, forming a triangle-like shape, thereby the drying agent bag will not fall apart easily, and the stability of the drying agent bag is improved.

Compared with the prior art, the fully automatic wafer packaging system of the present disclosure has the following beneficial effects:

With the fully automatic wafer packaging system of the present disclosure, a wafer can be placed into a wafer box by means of a wafer boxing device, the wafer box can be capped with a wafer box capping device, then a label can be attached to the wafer box by means of a wafer box labeling device, and the wafer box can be pushed into an aluminum foil bag opening and shaping device; at the same time, an aluminum foil bag is fed by an aluminum foil bag feeding device into the aluminum foil bag opening and shaping device, and the aluminum foil bag is opened and the shape of the opening is fixed by means of the aluminum foil bag opening and shaping device; the labeled wafer box is sent by the wafer box labeling device into the aluminum foil bag, then the aluminum foil bag containing the wafer box is sent by the aluminum foil bag opening and shaping device into a vacuum sealing device; at the same time, the drying agent bag is shaped and pushed by a drying agent bag shaping and pushing device at one side of the vacuum sealing device into the aluminum foil bag; and finally, the aluminum foil bag containing the wafer box and the drying agent bag is vacuum-sealed by means of the vacuum sealing device, and then is sent to a packaging device for packaging in a carton. Apparently, the entire wafer packaging process is automatically completed without manual packaging, and has high level of automation and high packaging efficiency, and achieves a good application effect.

Other advantages of the present disclosure and the technical effects of preferred embodiments will be further detailed below in embodiments.

Figure 1:
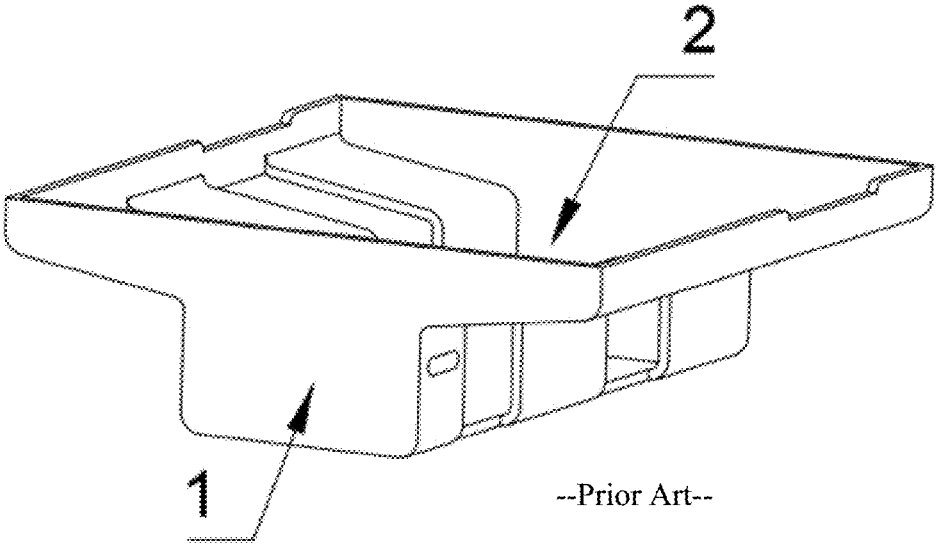
FIG. 1 is a schematic structural diagram of the bearing tray described in the Background Art section of the present disclosure.
Figure 2:
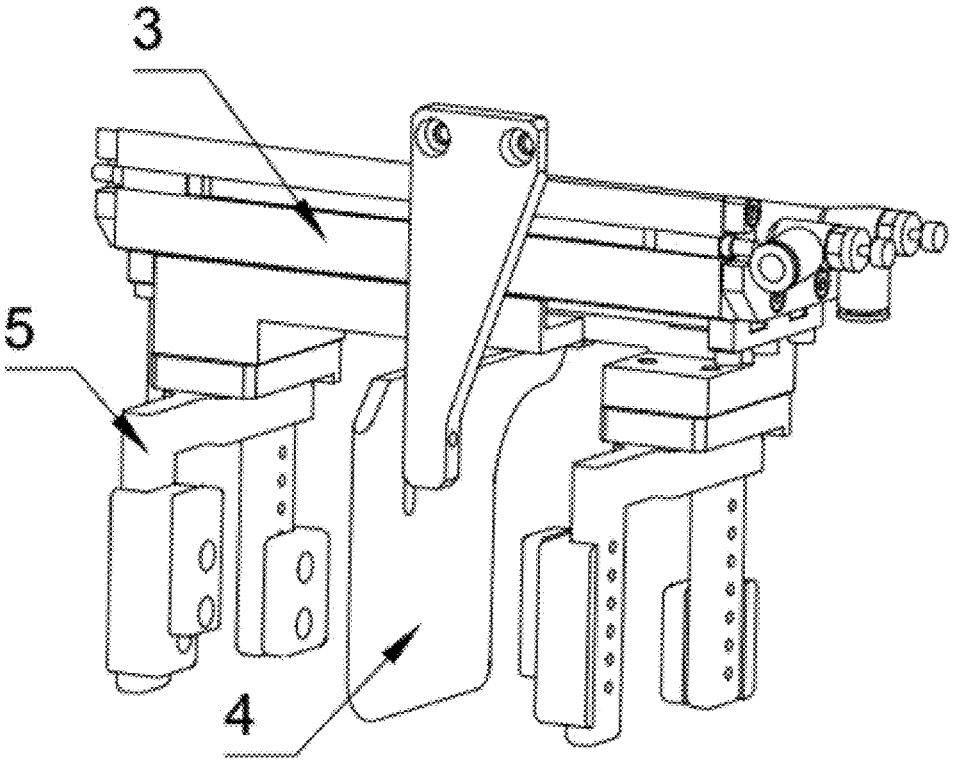
FIG. 2 is a schematic structural diagram of the top clamping device described in the Background Art section of the present disclosure.
Figure 3:
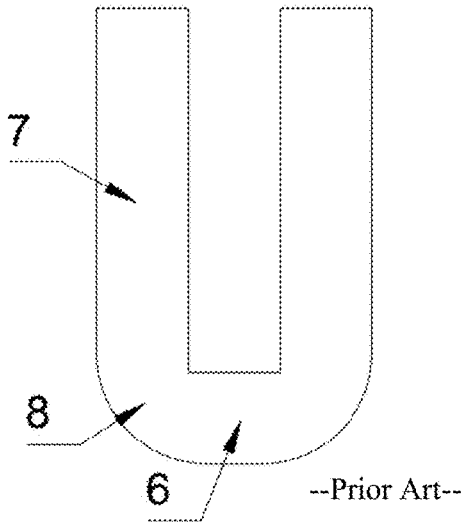
FIG. 3 is a schematic structural diagram of the drying agent bag described in the Background Art section of the present disclosure.

In the figures: 1—bearing plate, 2—groove, 3—top clamping device, 4—top plate, 5—caliper, 6—middle part, 7—tilted part, 8—bent part, 9—device base, 10—traverse moving rail, 11—traverse moving block, 12—long connecting block, 13—short connecting block, 14—shaping platform, 15—lifting frame, 16—lifting cylinder, 17—clamping cylinder, 18—cylinder connecting plate, 19—clamping plate connecting plate, 20—clamping plate, 21—positioning plate, 22—positioning plate connecting block, 23—middle plate, 24—side flap, 25—lifting pull plate, 26—overturning shaft, 27—gear shaft, 28—bearing gear, 29—toothed rack, 30—elastic member, 31—fixing base, 32—supporting block, 33—pulling plate lifting cylinder, 34—ejecting block, 35—ejecting cylinder, 36—lifting pull plate body, 37—overturning arm, 38—squeezed filler part, 39—front adjustment hole, 40—rear adjustment hole, 41—clamping plate bevel surface, 42—vertical long groove, 43—fixed part, 44—overturned part, 45—inclined part, 46—squeezed bent part, 47—squeezed vertical part, 48—shaping space, 49—convex side rib, 50—material pushing mechanism, 51—material feeding base, 52—flat placing plate, 53—suction disc, 54—material pushing block, 55—material pushing rod, 56—material pushing cylinder, 57—ranging guide base, 58—moving guide rod, 59—side material pushing guide plate, 60—long material pushing connecting block, 61—material push moving block, 62—material pushing moving guide rail, 63—wafer boxing device, 64—wafer box capping device, 65—wafer box labeling device, 66—aluminum foil bag feeding device, 67—aluminum foil bag opening and shaping device, 68—drying agent bag shaping and pushing device, 69—vacuum sealing device, 70—packaging device.

EMBODIMENTS

The present disclosure will be detailed below in embodiments, with reference to the accompanying drawings. However, it may be understood that the embodiments described herein are only provided for explaining and interpreting the present disclosure, and the scope of protection of the present disclosure is not limited to those embodiments.

Furthermore, in the present disclosure, it may be noted that the terms "install" and "connect" shall be interpreted in their general meanings, for example, a connection may be a fixed connection, a detachable connection, or an integral connection; may be a direct connection or an indirect connection via an intermediate medium, or internal communication between two elements or interaction between two elements, unless otherwise specified and defined explicitly. Those having ordinary skills in the art may interpret the specific meanings of the terms in the present disclosure in their context.

The technical scheme in the embodiments of the present disclosure will be detailed clearly and completely below with reference to FIGS. 4-13 of the embodiments. Obviously, the embodiments described herein are only some embodiments of the present disclosure, but not all possible embodiments of the present disclosure. Those having ordinary skills in the art can obtain other embodiments on the basis of the embodiments described herein without expending any creative labor; however, all such embodiments shall be deemed as falling in the scope of protection of the present disclosure.

As shown in FIGS. 5 to 13, in an aspect, the present disclosure provides a drying agent bag shaping and pushing device, which comprises a device base 9, wherein a traverse moving rail 10 is fixedly connected to a side of a top surface of the device base 9, a traverse moving block 11 is slidably connected to a top surface of the traverse moving rail 10, a long connecting block 12 is fixedly connected to a top surface of the traverse moving block 11, a short connecting block 13 is fixedly connected to an end of the long connecting block 12 away from the traverse moving block 11, and a shaping platform 14 is fixedly connected to a top surface of the short connecting block 13; during use, the traverse moving block 11 is moved on the traverse moving rail 10 in a traverse direction, drives the long connecting block 12 to move in the traverse direction, drives the short connecting block 13 to move in the traverse direction, and drives the shaping platform 14 to move in the traverse direction; a lifting frame 15 is provided on top of the shaping platform 14, lifting cylinders 16 are fixedly connected to two sides of the lifting frame 15, a clamping cylinder 17 is fixedly connected to a bottom surface of the lifting frame 15, cylinder connecting plates 18 are fixedly connected to two sides of a bottom surface of the clamping cylinder 17, a clamping plate 19 is fixedly connected to a bottom surface of the cylinder connecting plate 18, a clamping plate 20 is fixedly connected to a bottom surface of the clamping plate 19, a positioning plate 21 is provided between the clamping plates 20, and a front end and a rear end of the positioning plate 21 are fixedly connected to two sides of the lifting frame 15 via positioning plate connecting blocks 22; during use, the lifting cylinders 16 telescope up and down to drive the lifting frame 15 to move up and down, drive the clamping cylinders 17 to move up and down, and drive the clamping plates 20 and the positioning plate 21 to move up and down, and the clamping cylinders 17 telescope to drive the clamping plates 20 to clamp and loosen toward the middle positioning plate 21; a pushing mechanism 50 is provided on a side of the shaping platform 14 away from the traverse moving rail 10, and the pushing mechanism 50 pushes the shaped drying agent bag into a packaging bag.

A middle plate 23 is fixedly connected to a middle part of the shaping platform 14, side flaps 24 are symmetrically provided at two sides of the middle plate 23, a lifting pull plate 25 is provided at the bottom of the middle plate 23, a pulling plate lifting cylinder 33 is fixedly connected to a bottom surface of the lifting pull plate 25, the side flaps 24 and the lifting pull plate 25 are hinged together via an overturning shaft 26, a toothed rack 29 is provided on a bottom surface of the side flap 24, an end of the toothed rack 29 near the overturning shaft 26 is meshed with a bearing gear 28, a gear shaft 27 is fixedly connected to a middle part of the bearing gear 28, two ends of the gear shaft 27 are fixedly connected to two side walls of the shaping platform 14, an elastic member 30 is fixedly connected to an end of the side flap 24 away from the overturning shaft 26, the elastic member 30 is a spring or an elastic rubber rope, a fixing base 31 is fixedly connected to the other end of the elastic member 30, the fixing base 31 is fixedly connected to a side wall of the shaping platform 14, a supporting block 32 is provided on the bottom of an end of the side flap 24 fixedly connected with the elastic member 30, a top surface of the supporting block 32 is at the same level as the bottom surface of the side flap 24, the middle part of the lifting pull plate 25 is a lifting pull plate body 36, overturning arms 37 are provided at four corners of the lifting pull plate body 36, gaps exist between the overturning arms 37 located at two ends of the lifting pull plate body 36 respectively, an ejecting block 34 is provided between the middle plate 23 and the side flap 24, and a bottom of the ejecting block 34 passing through the lifting pull plate 25 is fixedly connected with an ejecting cylinder 35. During use, the ejecting cylinder 35 ejects upward and drives the ejecting block 34 to eject upward, so that the left and right sides of the fixed part 43 of the drying agent bag are ejected up, and the drying agent in the drying agent bag is separated to the two sides of the ejecting block 34; then the ejecting cylinder 35 retracts downward and drives the ejecting block 34 to retract downward, and, at that point, strip-shaped gaps without drying agent are formed at the left and right sides of the fixed part 43 of the drying agent bag; then the pulling plate lifting cylinder 33 pulls the lifting pulling plate 25 to move downward, which drives the side flaps 24 to turn over around the overturning shaft 26; when the side flaps 24 are turned over, the toothed racks 29 on the bottom of the side flaps 24 drive the bearing gear 28 to rotate until the entire side flaps 24 are pulled down to a level lower than or equal to the top surface of the middle plate 23, thus the side overturning in the shaping process of the drying agent bag is completed; the elastic member 30 at an end of the side flap 24 can produce an elastic pulling force when the side flap 24 is turned away from the fixing base 31, so that the toothed rack 29 on the bottom of the side flap 24 and the bearing gear 28 always remain in a meshed state, and will not fall toward the middle plate 23.

Figure 10:
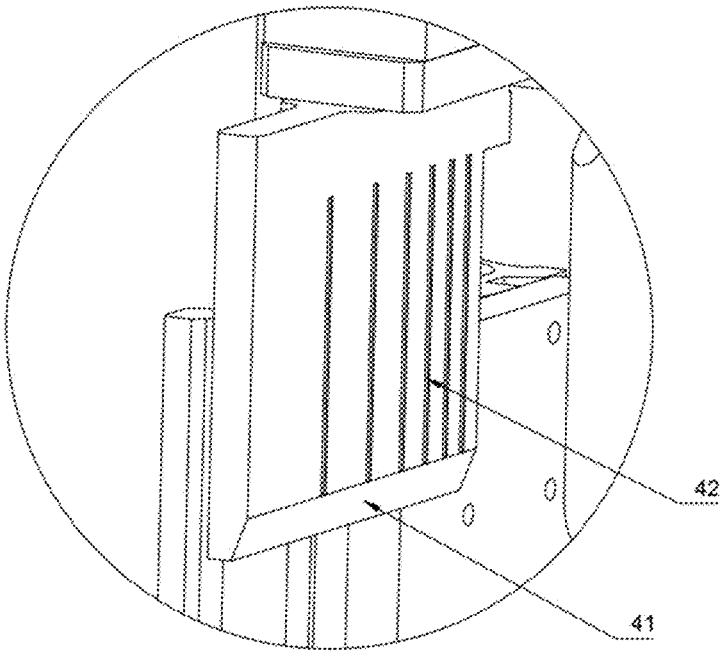
FIG. 10 is a structural schematic diagram of the part A in FIG. 5 in a partial enlarged view.
Figure 11:
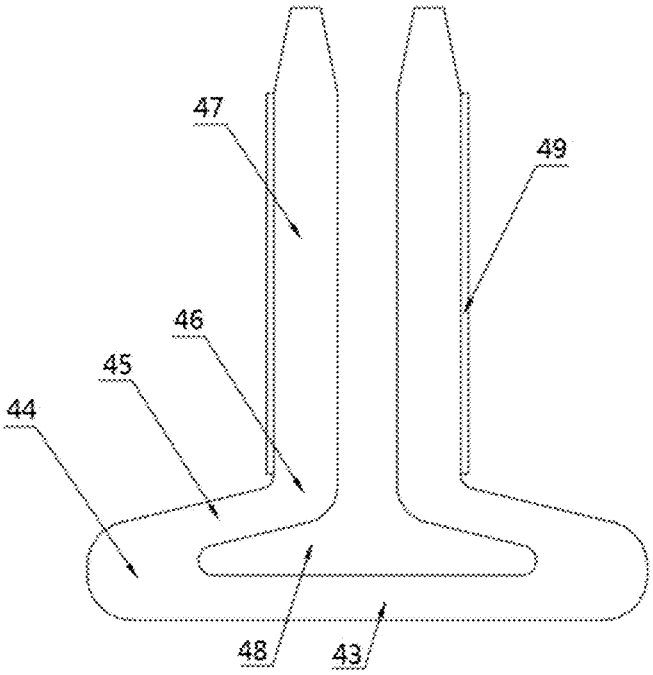
FIG. 11 is a schematic structural diagram of the drying agent bag according the present disclosure with a positioning plate in the middle.
Figure 12:
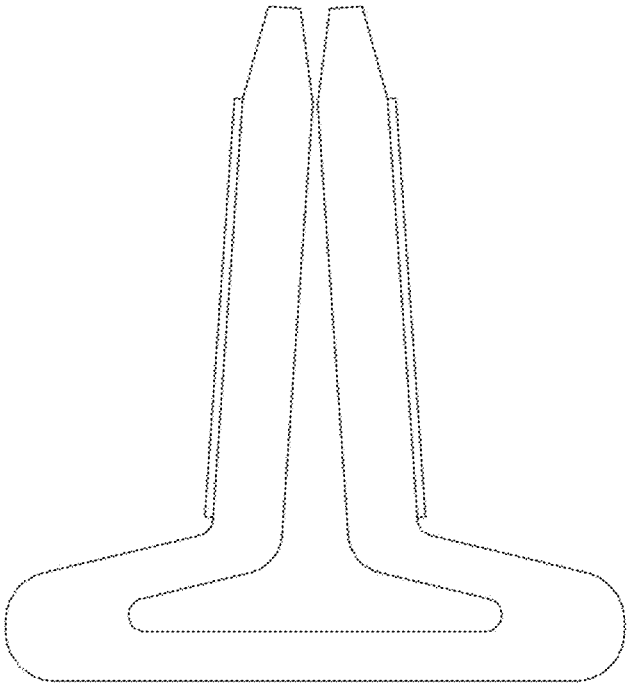
FIG. 12 is a schematic structural diagram of the drying agent bag of the present disclosure without a positioning plate in the middle.
Figure 13:
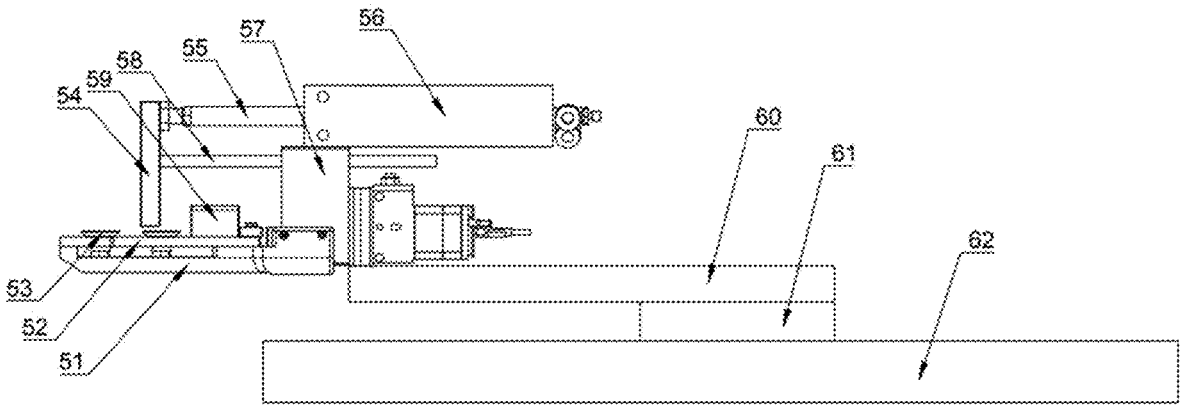
FIG. 13 is a schematic structural diagram of the material pushing mechanism of the present disclosure.

The positioning plate 21 is in the shape of a kitchen knife, and a squeezed filler part 38 is fixedly connected to the bottom of the positioning plate 21; the squeezed filler part 38 is made of an elastic and easily deformable material, and can be squeezed and deformed during the downward squeezing action of the positioning plate 21, that it fills the shaping space 48 formed in the middle part of the shaped drying agent bag as shown in FIG. 10; when the positioning plate 21 is withdrawn upward, the inclined part 45, the squeezed bent part 46 and the squeezed vertical part 47 of the shaped drying agent bag fall toward the middle part, as shown in FIG. 11; thus, the stability of the drying agent bag is ensured.

The clamping plate 20 is provided with a clamping plate bevel surface 41 on the bottom at a side near the positioning plate 21, and is provided with a plurality of vertical long grooves 42 on the side near the positioning plate 21, and the vertical long grooves 42 are arranged in a way that their distribution changes from sparse to dense in a direction away from the traverse moving rail 10; the clamping plate bevel surface 41 forces the drying agent bag to form an inclined part 45 when the drying agent bag is squeezed by the clamping plate 20, an squeezed bent part 46 is formed between the inclined part 45 and the squeezed vertical part 47, and the angle of the squeezed bent part 46 is an obtuse angle, the drying agent in the squeezed bent part 46 is squeezed and compressed, and a resilience force is formed inside in the drying agent, so that the squeezed vertical part 47 falls to the middle part under the action of the resilience force and forms a triangle-like shape when the support of the positioning plate 21 is lost, thereby the stability of the drying agent bag is improved; when a side of the clamping plate 20 squeezes the squeezed vertical part 47 of the drying agent bag, a portion of the squeezed vertical part 47 of the drying agent bag enters the vertical long grooves 42, forming convex side ribs 49 in a vertical strip shape, which can play a role of strengthening the structure of the squeezed vertical part 47 of the drying agent bag; the convex side ribs 49 are also arranged in a way that their distribution changes from sparse to dense in the direction away from the traverse moving rail 10; when the material pushing mechanism 50 pushes the shaped drying agent bag toward the packaging bag, the side with sparsely arranged convex side ribs 49 enters the packaging bag first; when the drying agent bag is pushed to the inner wafer box, the end of the drying agent bag that enters the packaging bag first falls apart because the strength of the portion of the drying agent bag with densely arranged convex side ribs 49 is greater than that of the portion of the drying agent bag with sparsely arrange convex side ribs 49; the portion of the drying agent bag that has fallen apart fills the space inside the packaging bag, consequently the outward resilience force produced by the accumulation and squeezing of the drying agent bag is decreased, so that the portion of the drying agent bag that enters the packaging bag later can fall apart. Thus, the device of the present disclosure prevents the drying agent bag from falling part before entering the packaging bag, so that the drying agent bag can fully utilize the internal space of the packaging bag, and will not be pushed out to the sealing part of the packaging bag easily by the resilience force generated by internal squeezing.

The material pushing mechanism 50 comprises a material feeding base 51, a flat placing plate 52 is fixedly connected to a top surface of the material feeding base 51, a suction disc 53 is provided on a middle part of the flat placing plate 52, a side material pushing guide plate 59 is provided on a side of the suction disc 53, a material pushing block 54 is provided above the material feeding base 51, a material pushing rod 55 is fixedly connected to a side of the material pushing block 54 near its top, a material pushing cylinder 56 is fixedly connected to the other end of the material pushing rod 55, a ranging guide base 57 is fixedly connected to the top of the material pushing cylinder 56, a moving guide rod 58 is slidably connected to a middle part of the ranging guide base 57, an end of the moving guide rod 58 is fixedly connected with the material pushing block 54, a long material pushing connecting block 60 is fixedly connected to a bottom surface of the ranging guide base 57, a material pushing moving block 61 is fixedly connected to the bottom surface of an end of the long material pushing connecting block 60 away from the material pushing block 54, and a material pushing moving guide rail 62 is slidably connected to a bottom surface of the pushing moving block 61. During use, the material pushing moving block 61 is moved on the material pushing moving guide rail 62, drives the long material pushing connecting block 60 to move, drives the ranging guide base 57 to move, drives the material feeding base 51 to move, drives the flat placing plate 52 to move, and drives the shaped drying agent bag to move; when the material feeding base 51 gets close to the opening of the packaging bag, the material pushing cylinder 56 drives the material pushing rod 55 to move, drives the material pushing block 54 to move, and pushes the drying agent bag from the flat placing plate 52 toward the packaging bag.

The working process of the drying agent bag shaping and pushing device of the present disclosure is as follows:

First, when the drying agent bag is shaped, the traverse moving block 11 is moved on the traverse moving rail 10 in a traverse direction, drives the long connecting block 12 to move in the traverse direction, drives the short connecting block 13 to move in the traverse direction, and drives the shaping platform 14 to move in the traverse direction, so that the drying agent bag laid flat on the shaping platform 14 is moved to a position below the positioning plate 21; at that point, the ejecting cylinder 35 ejects upward, and drives the ejecting block 34 to eject upward, so that the left and right sides of the fixed part 43 of the drying agent bag are ejected up, and the drying agent in the drying agent bag is separated to the two sides of the ejecting block 34; then the ejecting cylinder 35 retracts downward and drives the ejecting block 34 to retract downward, and at that point, strip-shaped gaps without drying agent are formed at the left and right sides of the fixed part 43 of the drying agent bag; then the pulling plate lifting cylinder 33 pulls the lifting pull plate 25 to move downward to drive the side flaps 24 to turn over around the overturning shaft 26;

At the same time, the lifting cylinder 16 retracts downward and drives the lifting frame 15 to move downward, which drives the clamping cylinder 17 to move downward, drives the clamping plates 20 and the positioning plate 21 to move downward, the positioning plate 21 extends to a position between the squeezed vertical parts 47, the clamping plates 20 extend to outer sides of the squeezed vertical parts 47, and the downward movement speed of the clamping plates 20 is the same as that of the side flaps 24 being pulled downward after they are overturned, so as to ensure that the clamping plates 20 and the side flaps 24 don't interfere with each other;

When the squeezed filler part 38 at the bottom of the positioning plate 21 comes into contact with the fixed part 43 of the drying agent bag and moves down further, the squeezed filler part 38 is squeezed and deformed during the downward squeezing action of the positioning plate 21, thereby fills a shaping space 48 formed in the middle of the shaped drying agent bag as shown in FIG. 10;

Then, the clamping cylinder 17 retracts and drives the clamping plates 20 on the two sides to clamp in the direction of the middle positioning plate 21; the clamping plate bevel surface 41 at the bottom of the clamping plate 20 forces the drying agent bag to form an inclined part 45 when the drying agent bag is squeezed by the clamping plate 20, an squeezed bent part 46 is formed between the inclined part 45 and the squeezed vertical part 47, the angle of the squeezed bent part 46 is an obtuse angle, and the drying agent in the squeezed bent part 46 is squeezed and compressed, so that a resilience force is formed therein; when the clamping plate 20 squeezes the squeezed vertical part 47 of the drying agent bag, a portion of the squeezed vertical part 47 of the drying agent bag enters the vertical long grooves 42, forming convex side ribs 49 in a vertical strip shape, which can play a role of strengthening the structure of the squeezed vertical part 47 of the drying agent bag;

Then, after the drying agent bag is clamped and shaped by the clamping plates 20 and the positioning plate 21, the lifting cylinder 16 extends upward and drives the lifting frame 15 to move upward, drives the clamping cylinder 17 to move upward, and drives the clamping plates 20 and the positioning plate 21 to move upward with the clamped drying agent bag;

Finally, the material pushing moving block 61 is moved on the material pushing moving guide rail 62, drives the long pushing connecting block 60 to move, drives the ranging guide base 57 to move, drives the material feeding base 51 to move, drives the placing plate 52 to move to the bottom of the drying agent bag; then the lifting cylinder 16 retracts downward, the drying agent bag is placed on the flat placing plate 52, and the suction disc 53 sucks the bottom of the drying agent bag; the material pushing moving block 61 continues driving the shaped drying agent bag to move; when the material feeding base 51 gets close to the opening of the packaging bag, the material pushing cylinder 56 pushes the material pushing rod 55 to move, drives the material pushing block 54 to move, and pushes the drying agent bag from the flat placing plate 52 to the packaging bag; thus, the drying agent bag shaping and pushing work is completed.

Figure 4:
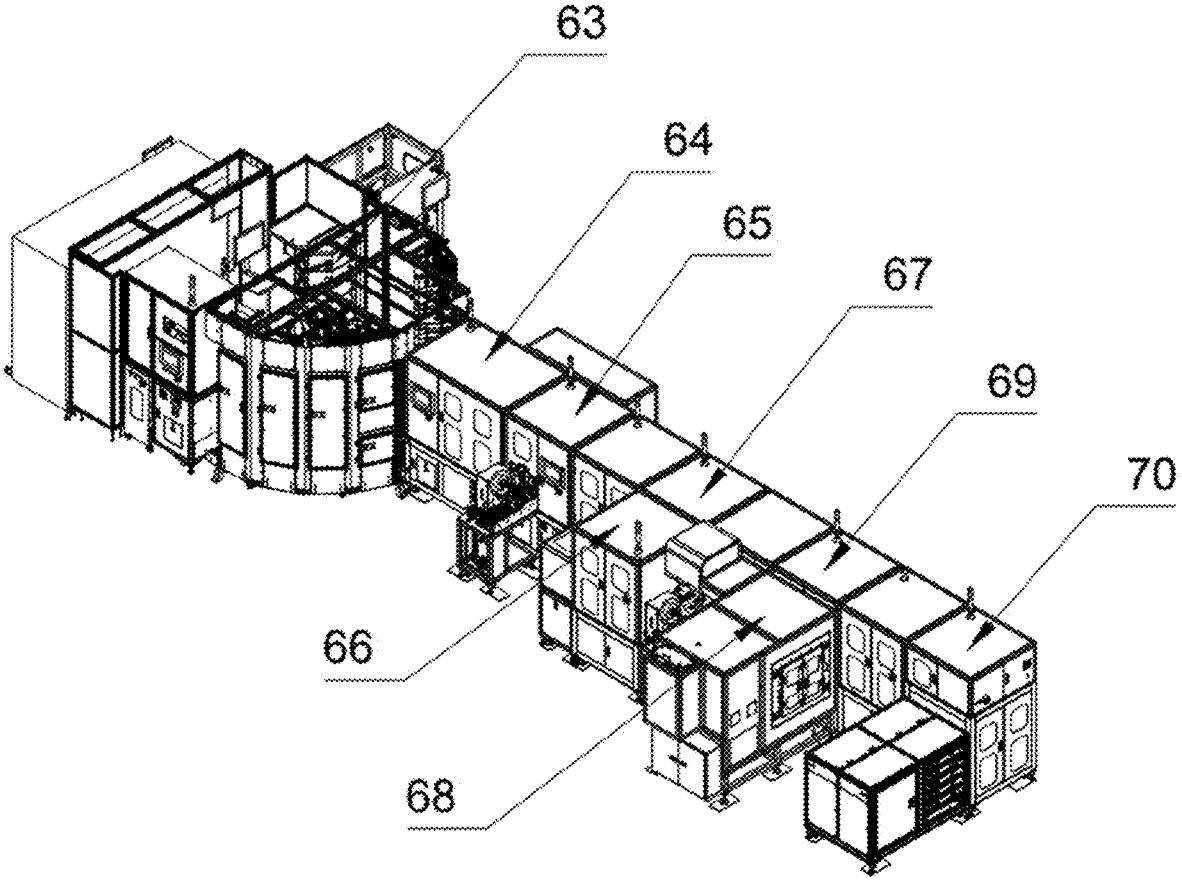
FIG. 4 is an overall schematic structural diagram of the fully automatic wafer packaging system of the present disclosure.
Figure 5:
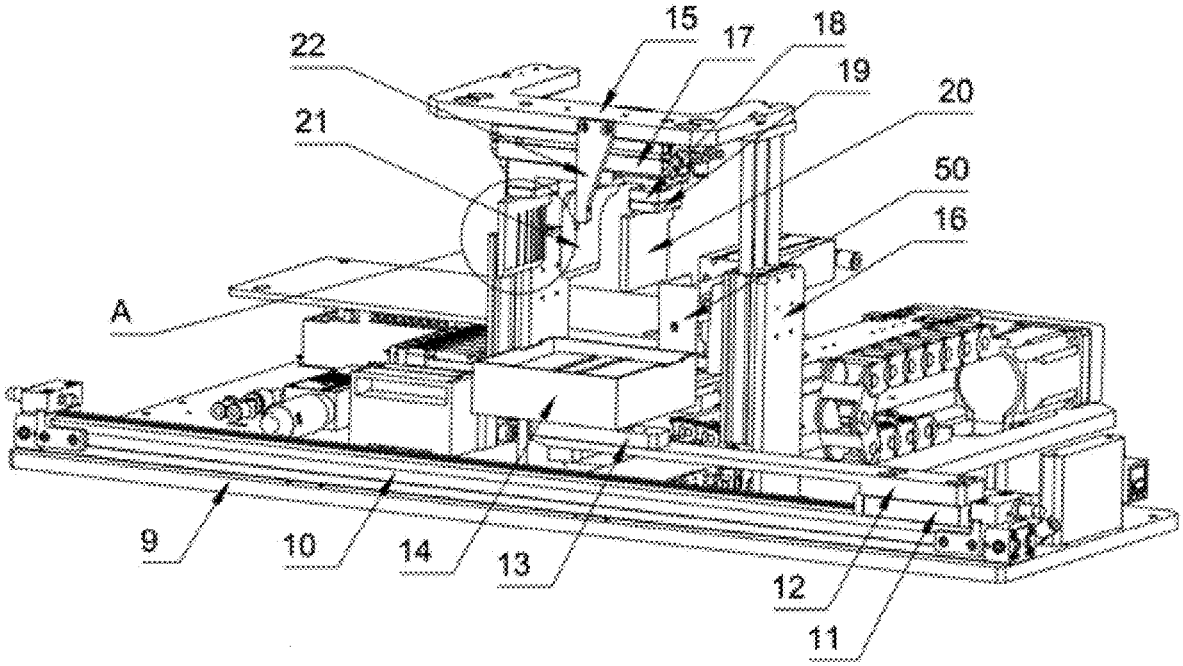
FIG. 5 is a schematic structural diagram of the drying agent bag shaping and pushing device of the present disclosure.
Figure 6:
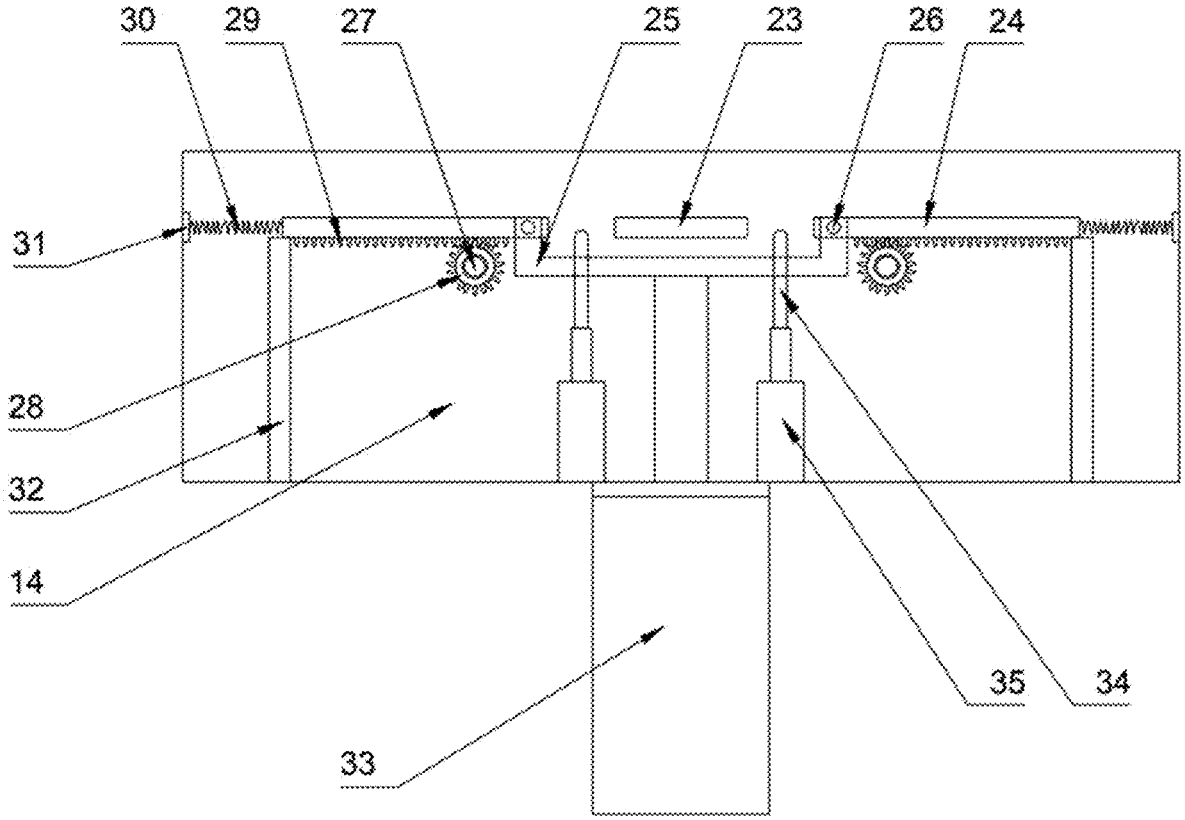
FIG. 6 is a schematic structural diagram of the shaping platform of the present disclosure in a sectional view.
Figure 7:
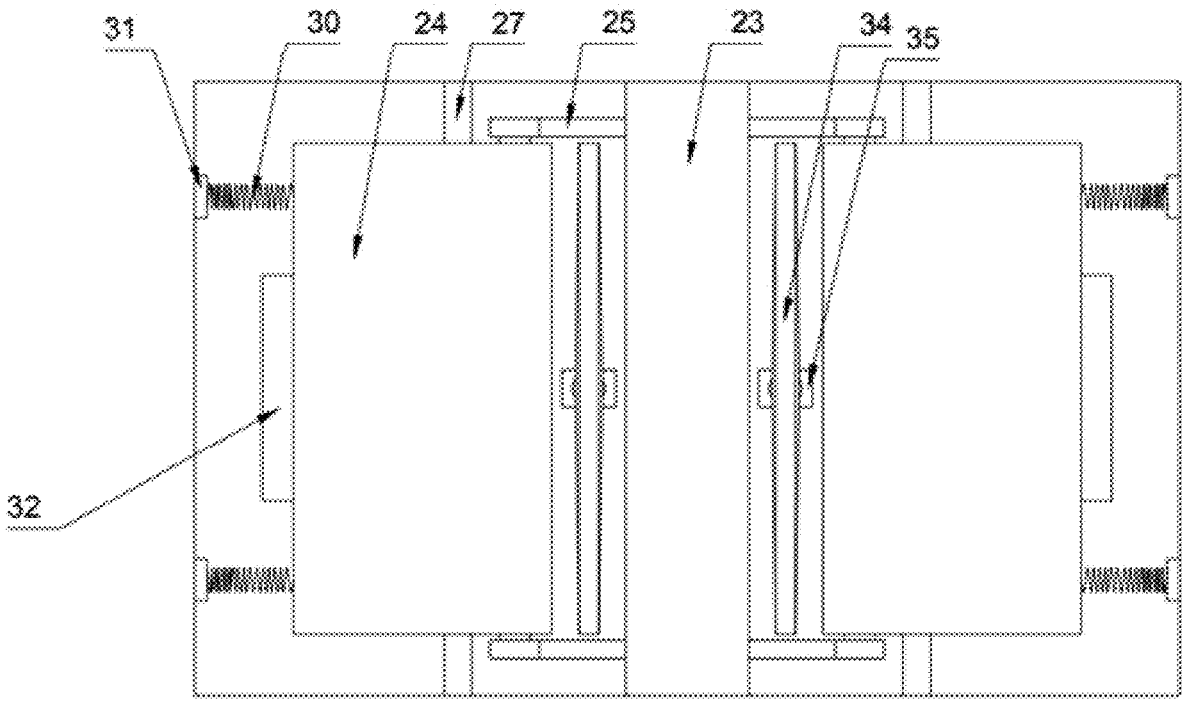
FIG. 7 is a structural schematic diagram of the shaping platform of the present disclosure in a top view.
Figure 8:
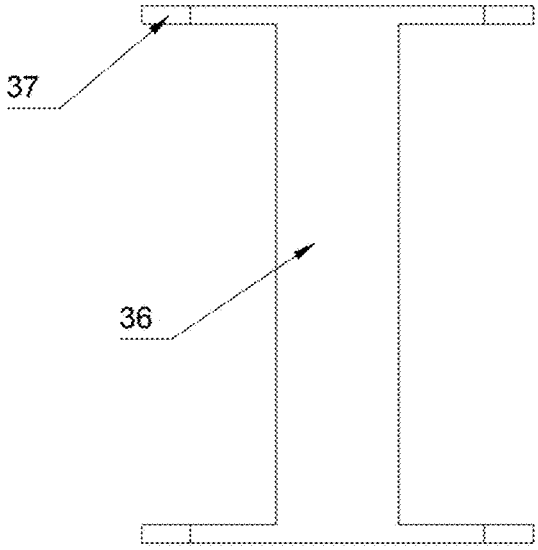
FIG. 8 is a schematic structural diagram of the lifting pull plate of the present disclosure.
Figure 9:
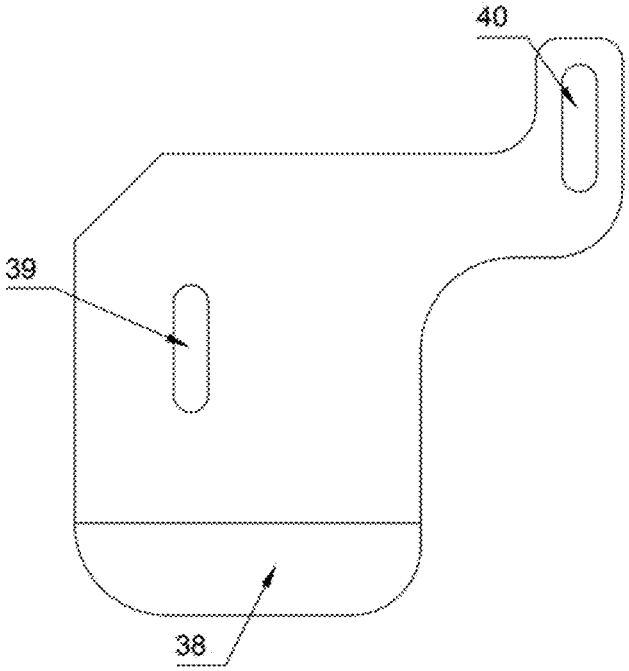
FIG. 9 is a structural schematic diagram of the positioning plate of the present disclosure.

As shown in FIG. 4, in another aspect, the present disclosure provides a fully automatic wafer packaging system, which comprises a wafer boxing device 63, wherein a wafer box capping device 64 is fixedly connected to an end of the wafer boxing device 63, a wafer box labeling device 65 is fixedly connected to the other side of the wafer box capping device 64, an aluminum foil bag feeding device 66 is fixedly connected to the other side of the wafer box labeling device 65, an aluminum foil bag opening and shaping device 67 is fixedly connected to the other side of the aluminum foil bag feeding device 66, a drying agent bag shaping and pushing device 68 is fixedly connected to the other side of the aluminum foil bag opening and shaping device 67, a vacuum sealing device 69 is fixedly connected to one side of the drying agent bag shaping and pushing device 68, and a packaging device 70 is fixedly connected to the other side of the drying agent bag shaping and pushing device 68.

Compared with the prior art, the wafer box labeling device has the following two beneficial effects:

1. When the wafer box labeling device of the present disclosure is used, the user may put the material into a feeding barrel by means of a semiconductor reel, and the semiconductor reel automatically falls to the bottom of the feeding barrel; when the semiconductor reel is conveyed to a position below a brush roller, the brush roller contacts with the semiconductor reel and brushes adhesive onto the semiconductor reel; when the semiconductor reel is moved a position below a labeling assembly, the labeling assembly peels off a label therein, and presses the label onto the semiconductor reel for labeling; when the semiconductor reel is moved to a position below a pressing roller, the pressing roller presses the label on the top of the semiconductor reel, so that the label is attached to the semiconductor reel more firmly. The automatic labeling device is beneficial to improving the labeling efficiency and reducing the labor cost.
2. When a movable labeling block gradually protrudes out of a labeling through-slot as rotating roller rotate, the movable labeling block can be retracted in the empty slot, and two movable rollers can be pressed and lowered by squeezing the label tape, so as to facilitate the retraction and cushion the label tape; when the label tape is rotated to the top of the semiconductor reel, the movable labeling block slides to the outermost side of a limiting chute and contacts with the semiconductor reel; at that point, the label tape is reset under the pushing action of the second elastic member and the adhesive effect, while a label is attached to the semiconductor reel, thus the labeling of the semiconductor reel is completed. In that way, accurate label stripping and label attachment can be carried out conveniently. The distance between the arc-shaped parts at the outer side of the power winding roller in one revolution is equal to the distance between every two arc-shaped pushing blocks, and a semiconductor reel can be taken away whenever an arc-shaped pushing block passes through the bottom of the feeding barrel; since the arc-shaped pushing blocks are distributed evenly, the material feeding is more uniform. Since the linear distance between two arc-shaped pushing blocks is equal to the distance between the arc-shaped parts at the outer side of two labeling through-slots, each semiconductor reel corresponds to a movable labeling block. Thus, automatic calibration can be performed, the use of optical fiber positioning can be reduced, and the transmission structure requires less power from a power source and greatly saves the power resource.

The working process of the fully automatic wafer packaging system of the present disclosure is as follows (all of the wafer boxing device 63, the wafer box capping device 64, the wafer box labeling device 65, the aluminum foil bag feeding device 66, the aluminum foil bag opening and shaping device 67, the vacuum sealing device 69 and the packaging device 70 employ existing structures in the prior art): a wafer is placed into a wafer box by means of the wafer boxing device 63; then the wafer box is fed into the wafer box capping device 64 and is capped; then the wafer box is fed into the wafer box labeling device 65 and a label is attached to the wafer box; at the same time, an aluminum foil bag is fed to the aluminum foil bag opening and shaping device 67 by means of the aluminum foil bag feeding device 66, and the aluminum foil bag is opened and the opening of the aluminum foil bag is fixed by the aluminum foil bag opening and shaping device 67; then the labeled wafer box is sent into the aluminum foil bag by the wafer box labeling device 65; then the aluminum foil bag containing the wafer box is sent into the vacuum sealing device 69 by the aluminum foil bag opening and shaping device 67; at that point, the drying agent bag shaping and pushing device 68 at one side of the vacuum sealing device 69 acts to shape the drying agent bag and push it into the aluminum foil bag, then the aluminum foil bag is vacuumized and sealed by the vacuum sealing device 69, and finally the sealed aluminum foil bag is sent to the packaging device 70 by the vacuum sealing device 69 for packaging in a carton. Thus, the entire automatic packaging process of the wafer is completed.

While some preferred embodiments of the present disclosure are described above with reference to the accompanying drawings, the present disclosure is not limited to the details in those embodiments. Those skilled in the art can make various simple modifications and variations to the technical scheme of the present disclosure, without departing from the technical concept of the present disclosure. However, all these simple modifications and variations shall be deemed as falling in the scope of protection of the present disclosure.

In addition, it may be noted that the specific technical features described in above specific embodiments may be combined in any appropriate form, provided that there is no conflict among them. To avoid unnecessary repetition, various possible combinations are not described specifically in the present disclosure.

Moreover, different embodiments of the present disclosure may also be combined freely as required, as long as the combinations don't deviate from the ideal of the present disclosure. However, such combinations shall also be deemed as being disclosed in the present disclosure.

The invention claimed is:

1. A drying agent bag shaping and pushing device, comprising a device base, wherein a traverse moving rail is fixedly connected to a side of a top surface of the device base, a traverse moving block is slidably connected to a top surface of the traverse moving rail, a long connecting block is fixedly connected to a top surface of the traverse moving block, and a short connecting block is fixedly connected to one end of the long connecting block away from the traverse moving block; characterized in that a shaping platform is fixedly connected to a top surface of the short connecting block, a lifting frame is provided on top of the shaping platform, lifting cylinders are fixedly connected to two sides of the lifting frame, a clamping cylinder is fixedly connected to a bottom surface of the lifting frame, cylinder connecting plates are fixedly connected to two sides of a bottom surface of the clamping cylinder, a clamping plate connecting plate is fixedly connected to a bottom surface of each of the cylinder connecting plates, respectively, and a clamping plate is fixedly connected to a bottom surface of each of the clamping plate connecting plates, respectively.

2. The drying agent bag shaping and pushing device of claim 1, wherein a positioning plate is provided between the clamping plates, a front end and a rear end of the positioning plate are fixedly connected to two sides of the lifting frame via positioning plate connecting blocks, and a material pushing mechanism is provided on a side of the shaping platform away from the traverse moving rail.

3. The drying agent bag shaping and pushing device of claim 2, wherein a middle plate is fixedly connected to a middle part of the shaping platform, side flaps are symmetrically provided on two sides of the middle plate, a lifting pull plate is provided at the bottom of the middle plate, a pull plate lifting cylinder is fixedly connected to a bottom surface of the lifting pull plate, the side flaps and the lifting pull plate are hinged together via an overturning shaft, a toothed rack is provided on a bottom surface of the side flap, an end of the toothed rack near the overturning shaft is meshed with a bearing gear, a gear shaft is fixedly connected to a middle part of the bearing gear, two ends of the gear shaft are fixedly connected to two side walls of the shaping platform, an end of the side flap away from the overturning shaft is fixed connected with an elastic member, the other end of the elastic member is fixedly connected to a fixing base, and the fixing base is fixedly connected to a side wall of the shaping platform.

4. The drying agent bag shaping and pushing device of claim 3, wherein a supporting block is provided at the bottom of an end of the side flap fixedly connected with the elastic member, and a top surface of the supporting block is at the same level as the bottom surface of the side flap.

5. The drying agent bag shaping and pushing device of claim 4, wherein the middle part of the lifting pull plate is a lifting pull plate body, overturning arms are provided at four corners of the lifting pull plate body, and gaps exist between the overturning arms located at two ends of the lifting pull plate body respectively.

6. The drying agent bag shaping and pushing device of claim 5, wherein an ejecting block is provided between the middle plate and the side flap, and a bottom of the ejecting block passing through the lifting pull plate is fixedly connected with an ejecting cylinder.

7. The drying agent bag shaping and pushing device of claim 2, wherein a squeezed filler part is fixedly connected to the bottom of the positioning plate, and the squeezed filler part is made of an elastic and easily deformable material.

8. The drying agent bag shaping and pushing device of claim 2, wherein each of the clamping plates is provided with a clamping plate bevel surface at the bottom near the positioning plate.

9. The drying agent bag shaping and pushing device of claim 8, wherein a side of the clamping plate near the positioning plate is provided with a plurality of vertical long grooves.

10. The drying agent bag shaping and pushing device of claim 9, wherein the vertical long grooves are arranged in a way that their distribution changes from sparse to dense in a direction away from the traverse moving rail.

11. The drying agent bag shaping and pushing device of claim 2, wherein the material pushing mechanism comprises a material feeding base, a flat placing plate is fixedly connected to a top surface of the material feeding base, a suction disc is provided on a middle part of the flat placing plate, a side material pushing guide plate is provided at a side of the suction disc, a material pushing block is provided above the material feeding base, a material pushing rod is fixedly connected to a side of the material pushing block near its top, a material pushing cylinder is fixedly connected to the other end of the material pushing rod, a ranging guide base is fixedly connected to the top of the material pushing cylinder, a moving guide rod is slidably connected to a middle part of the ranging guide base, an end of the moving guide rod is fixedly connected with the material pushing block, a long material pushing connecting block is fixedly connected to a bottom surface of the ranging guide base, a material pushing moving block is fixedly connected to the bottom surface of an end of the long material pushing connecting block away from the material pushing block, and a material pushing moving guide rail is slidably connected to a bottom surface of the material pushing moving block.

12. A fully automatic wafer packaging system, comprising a wafer boxing device, a wafer box capping device, a wafer box labeling device, an aluminum foil bag feeding device, an aluminum foil bag opening and shaping device, and the drying agent bag shaping and pushing device of claim 1, a vacuum sealing device, and a packaging device which are connected in sequence.

* * * * *